US011736868B2

(12) United States Patent
Brouwer et al.

(10) Patent No.: US 11,736,868 B2
(45) **Date of Patent: *Aug. 22, 2023**

(54) METHOD OF DETERMINING A STATUS OF AN ACOUSTIC FEEDBACK PATH OF A HEAD WEARABLE HEARING DEVICE AND A HEAD WEARABLE HEARING DEVICE

(71) Applicant: GN Hearing A/S, Ballerup (DK)

(72) Inventors: Theodorus Geradus Maria Brouwer, Heemstede (NL); Aart Zeger Van Halteren, Woudenberg (NL); Andreas Tiefenau, Gammel Holte (DK)

(73) Assignee: GN HEARING A/S, Ballerup (DK)

( * ) Notice: Subject to any disclaimer, the term of this patent is extended or adjusted under 35 U.S.C. 154(b) by 0 days.

This patent is subject to a terminal disclaimer.

(21) Appl. No.: 17/396,631

(22) Filed: Aug. 6, 2021

(65) Prior Publication Data

US 2021/0377673 A1 Dec. 2, 2021

Related U.S. Application Data

(63) Continuation of application No. 16/717,132, filed on Dec. 17, 2019, now Pat. No. 11,317,222.

(30) Foreign Application Priority Data

Dec. 28, 2018 (EP) ..... 18248206

(51) Int. Cl.
*H04R 25/00* (2006.01)

(52) U.S. Cl.
CPC ..... *H04R 25/305* (2013.01); *H04R 25/453* (2013.01); *H04R 25/505* (2013.01);
(Continued)

(58) Field of Classification Search
CPC ..... H04R 25/505; H04R 2460/11
(Continued)

(56) References Cited

U.S. PATENT DOCUMENTS 8,923,543 B2 12/2014 Sacha et al.
9,596,551 B2 3/2017 Pedersen et al.
(Continued)

FOREIGN PATENT DOCUMENTS

DE 19942707 A1 3/2001
DE 10141800 C1 1/2003
(Continued)

OTHER PUBLICATIONS

Non-Final Office Action for U.S. Appl. No. 16/717,132 dated Jul. 17, 2020.
(Continued)

*Primary Examiner* — George C Monikang
(74) *Attorney, Agent, or Firm* — Vista IP Law Group, LLP

(57) ABSTRACT

A method performed by a hearing device comprising a first housing, a microphone, a speaker, and a first control system configured to control an active vent, the active vent comprising a vent canal and a valve member configured to block the vent canal when the active vent is in the closed state, and to allow passage of air through the vent canal when the active vent is in the open state, comprising: emitting an acoustic signal from the speaker; measuring a first transfer function of an acoustic feedback path between the speaker and the microphone when the active vent is expected to be in the open state; measuring a second transfer function of the acoustic feedback path when the active vent is expected to be in the closed state; and determining a status of the active vent based at least on the first and second measured transfer functions.

22 Claims, 8 Drawing Sheets

(52) U.S. Cl.
CPC ..... *H04R 25/604* (2013.01); *H04R 2225/025* (2013.01); *H04R 2460/11* (2013.01)

(58) Field of Classification Search
USPC ..... 381/312, 322
See application file for complete search history.

(56) References Cited

U.S. PATENT DOCUMENTS

| | | | |
|---|---|---|---|
| 9,924,276 | B2 | 3/2018 | Wenzel |
| 2011/0129108 | A1 | 6/2011 | Miller et al. |
| 2014/0169603 | A1 | 6/2014 | Sacha et al. |
| 2014/0321682 | A1 | 10/2014 | Kofod-Hansen et al. |
| 2015/0230036 | A1 | 8/2015 | Pedersen et al. |
| 2020/0213731 | A1 | 7/2020 | Miller et al. |

FOREIGN PATENT DOCUMENTS

| | | | |
|---|---|---|---|
| DE | 102008021613 | A1 | 11/2009 |
| EP | 2071872 | A1 | 6/2009 |
| EP | 2835987 | A1 | 2/2015 |
| EP | 3139638 | A1 | 3/2017 |
| WO | WO 2012/149970 | A1 | 11/2012 |

OTHER PUBLICATIONS

Non-Final Office Action for U.S. Appl. No. 16/717,132 dated Dec. 15, 2020.
Final Office Action for U.S. Appl. No. 16/717,132 dated May 4, 2021.
Amendment Response to NFOA for U.S. Appl. No. 16/717,132 dated Oct. 22, 2020.
Amendment Response to NFOA for U.S. Appl. No. 16/717,132 dated Mar. 31, 2021.
Amendment Response to FOA for U.S. Appl. No. 16/717,132 dated Aug. 5, 2021.
Final Office Action for the U.S. Appl. No. 16/717,132 dated May 4, 2021.
Non-Final Office Action for the U.S. Appl. No. 16/717,132 dated Dec. 15, 2020.
Non-Final Office Action for the U.S. Appl. No. 16/717,132 dated Jul. 17, 2020.
Notice of Allowance for the U.S. Appl. No. 16/717,132 dated Aug. 24, 2021.
Extended European Search Report dated May 4, 2020 for corresponding European Application No. 19217727.7.
Extended European Search Report dated Jun. 28, 2019 for corresponding European Application No. 18248206.7.

METHOD OF DETERMINING A STATUS OF AN ACOUSTIC FEEDBACK PATH OF A HEAD WEARABLE HEARING DEVICE AND A HEAD WEARABLE HEARING DEVICE

RELATED APPLICATION DATA

This application is a continuation of U.S. patent application Ser. No. 16/717,132 filed on Dec. 17, 2019, pending, which claims priority to, and the benefit of, European Patent Application No. 18248206.7 filed on Dec. 28, 2018. The entire disclosure of the above application is expressly incorporated by reference herein.

FIELD

The present disclosure relates to a method of determining a status of an acoustic feedback path of a head wearable hearing device. The disclosure also relates to a head wearable hearing device with a status control system for determining a status of an acoustic feedback path of the head wearable hearing device.

BACKGROUND

In head wearable hearing devices, such as headsets, ear plugs, hearing instruments, and hearing aids, having components located in the ear canal, it may be necessary or desirable to provide a vent. A vent is a physical passageway such as a canal or tube primarily placed to offer pressure equalization across a housing placed in the ear (such as an ITE (in-the-ear) hearing device, an ITE housing of a BTE (behind-the-ear) hearing device, a CIC (complete-in-canal) hearing device, a RIE (receiver-in-the-ear) hearing device, a receiver-in-canal (RIC) hearing device, or a dome tip/earmold. In such systems there may be a problem with feedback. Feedback, a squealing/whistling is caused by sound (particularly high frequency sound) leaking through the vent, and being amplified again. However, different vent styles and sizes can be used to influence and prevent feedback. Also, some modern circuits are able to provide feedback regulation or cancellation to assist with this. Such systems are known as Digital Feedback Suppression (DFS) systems. A DFS system counteracts feedback by modelling the feedback path and subtracting the simulated feedback signal from the input signal at the head wearable hearing device's microphone(s). Adaptive DFS systems follow—during wearing time—changes in the feedback path, and adapt the simulated feedback path to cancel out any possibly occurring instability and/or artifacts.

Hearing aids can be connected wirelessly to e.g. FM systems, for instance with a body-worn FM receiver with induction neck-loop which transmits the audio signal from the FM transmitter inductively to the telecoil inside the head wearable hearing device. Similarly, head wearable hearing devices may be connected to other wireless devices such as computers, remote control, TV, remote microphone systems, cloud, other head wearable hearing devices or mobile phones or pods, e.g. for receiving and/or transmitting audio signals.

In order to address the different modes of using the head wearable hearing device (the near field acoustic environment, such as noisy restaurant, clean speech or music listening, etc.) the vent of a housing located in the ear canal (a dome tip/earmold/receiver in canal (RIC)), may further be provided with a valve, which may be used to close the vent in some instances and to open the vent in other instances.

It is a problem that such valves may get stuck, i.e. will not change state anymore, in an opened, a closed or a semi closed position. This is to be expected during the lifetime of the head wearable hearing device, e.g. due to clogging. Another problem may be that a wax filter in the housing located in the ear canal of a user gets clogged in such a way that the audio performance is significantly reduced. It would considerably improve the operation of a head wearable hearing device if a clear indication of the status of the valve and/or the acoustic pathway may be achieved.

Several ways of providing such detection are conceivable, but currently there is no way of easily detecting the state of the valve, open or closed.

There is thus a need for a reliable and easily implementable way of detecting the status of an acoustic feedback path in a head wearable hearing device and head wearable hearing device system.

SUMMARY

It is therefore an object to provide a reliable and easily implementable way of detecting the status of an acoustic feedback path in a head wearable hearing device and head wearable hearing device system.

In a first aspect, this is achieved by a method of determining a status of an acoustic feedback path of a head wearable hearing device, the head wearable hearing device comprising a first housing being located in the ear canal of a user, a microphone, and a first control system configured for controlling the active vent of the first housing between an open state and a closed state;

the first housing comprising a loudspeaker, the method comprising the steps of:

emitting an acoustic signal from said loudspeaker measuring a first transfer function of the acoustic feedback path between the loudspeaker and the microphone in response to the emitted signal, when the active vent is expected to be in an open state;

measuring a second transfer function of the acoustic feedback path between the loudspeaker and the microphone in response to the emitted signal, when the active vent is expected to be in a closed state;

determining the state of the active vent based at least on a comparison the first and second measured transfer functions.

The first housing may comprise a proximal end and a distal end.

The active vent may comprise a vent canal forming a passage for air through the first housing from the proximal end to the distal end of the first housing. The active vent may further comprise a valve member configured for blocking said vent canal to provide said closed state of the active vent, and configured for allowing passage of air through the vent canal to provide said open state of the active vent.

Depending on the nature of any acoustic signal emitted from the loudspeaker, the first control system controls the active vent to be in either the open state or in the closed state. Thus, depending on the nature of any acoustic signal at a given time the first control system may expect the active vent to be in the open state or in the closed state.

The emitted acoustic signal may be a predetermined probe sound/signal, or the emitted acoustic signal may be sounds such as speech or music obtained from the surroundings of the user, such as during normal use of the head wearable hearing device. Preferably, the emitted sound may be configured or chosen such that is has characteristics that results in specific detectable/measurable expected transfer functions in response to the active vent being in both the closed state and the open state, respectively. Alternatively, the emitted acoustic signal may be a sound that is adapted for the expected state, i.e. either the open or the closed state, of the active vent.

Thus, the open state of the active vent may be defined as when the valve member allows passage of air through the vent canal of the active vent. Correspondingly, the closed state of the active vent may be defined as when the valve member prevents air passage through the vent canal of the active vent.

The steps of the method may be executed by a status control system.

The status control system may form part of the first control system

When the status of the of an acoustic feedback path of a head wearable hearing device is determined, a status signal may be provided by the control system. In an embodiment the status signal is saved to a memory of the head wearable hearing device. In embodiment the provided status signal may cause a visual or acoustic indicator of the head wearable hearing device to notify the user.

In an embodiment the method comprises providing a first command signal to the active vent to open;

in a predetermined first time window after providing the first command signal, measuring the first transfer function;

providing a second command signal to the active vent to close;

in a predetermined second time window after providing the command signal to the active vent to close, measuring the second transfer function;

performing a first comparison of the measured first transfer function and the measured second transfer function relative to a first predetermined variance.

In an embodiment the first time window is 5-15 msec, such as 10 msec. In a further embodiment the second time window is 5-15 msec, such as 10 msec.

Thus, the active vent may be expected to be in an open state, when the first command signal is provided by the first control system to the active vent. The first command signal is sent to the active vent dependent on the nature of the acoustic signal emitted from the loudspeaker at that time.

Correspondingly, the active vent may be expected to be in a closed state, when the second command signal is provided by the first control system to the active vent, dependent on the nature of the acoustic signal emitted from the loudspeaker at this time.

The active vent may comprise an electrodynamic actuator, such as a linear actuator, responsive to the first command signal and second command signal to set an open state or closed state of the active vent. The electrodynamic actuator may comprise a drive coil and a displaceable valve member. The displaceable valve member may comprise a permanent magnet which is attracted to, or repelled by, the drive coil depending on a direction of a drive current resulting from the first and second command signals. The first command signal and the second command signal may be generated by a digital processor of the first control system for example via a controllable output port of the digital processor where the controllable output port is electrically connected to the active vent.

In a further embodiment, the method comprises determining an expected first transfer function for the acoustic feedback path between the loudspeaker and the microphone in response to the emitted acoustic signal corresponding to an open state of the active vent, and/or determining an expected second transfer function for the acoustic feedback path between the loudspeaker and the microphone in response to the emitted acoustic signal corresponding to an closed state of the active vent, and determining the state of the active vent further based on a comparison of the first and/or the second measured transfer functions, with the expected first transfer function, or the expected second transfer function.

In a further embodiment, the determination of the expected first transfer function and/or the expected second transfer function is based on measurements made during a fitting session for adapting the head wearable hearing device to a specific user, based on which measurements a norm feedback transfer function for the active vent in open state and a norm feedback transfer function for the active vent in closed state are made and stored in a status control system.

In a further embodiment, the first control system comprises an adaptive digital feedback suppression (DFS) system.

In a further embodiment, the adaptive digital feedback suppression (DFS) system comprises an adaptive digital filter, such as a FIR filter, comprising a plurality of filter coefficients modelling an impulse response of the acoustic feedback path or modelling a frequency response of the acoustic feedback path.

In a further embodiment, determination of the expected transfer functions for the acoustic feedback path (FB) in response to the emitted acoustic signal (RS) is based on information from the digital feedback suppression (DFS) system (200).

Preferably, also the method of determining a status of an acoustic feedback path FB of the head wearable hearing device is executed by the first control system. However, in alternative embodiments, method of determining a status of an acoustic feedback path FB of the head wearable hearing device may be executed by a separate, second control system, the status control system.

In an embodiment the determination of the expected transfer functions for the acoustic feedback path in response to the emitted acoustic signal is based on control information from the digital feedback suppression system including an intended state of the active vent.

In an embodiment, the method further comprises determining that the active vent is stuck in an open position, if in a first comparison the measured first transfer function is, within the first predetermined variance, equal to the measured second transfer function; and if in a second comparison the measured second transfer function is, within a predetermined second variance, equal to the expected first transfer function.

The first comparison may be provided by subtracting the measured second transfer function from the measured first transfer function, and determining if the difference is/lies within the an upper limit and lower limit of the predetermined first variance.

The second comparison may be provided by subtracting the expected first transfer function from the measured second transfer function, and determining if the difference is/lies within an upper limit and a lower limit of the predetermined second variance.

A first status signal may be provided if the active vent is stuck in an open position.

In a further embodiment the method may comprise determining that the active vent is stuck in a closed position or that the active vent is clogged, if in the first comparison the measured first transfer function is, within the first predetermined variance, equal to the measured second transfer function; if in a second comparison the measured second transfer function is, within the predetermined second variance, not equal to the expected first transfer function, and if in a third comparison the measured first transfer function is, within the third predetermined variance, equal to the expected second transfer function.

The third comparison may be provided by subtracting the expected second transfer function from the measured first transfer function, and determining if the result is within the an upper limit and a lower limit of the predetermined third variance.

A second status signal may be provided if the active vent is stuck in a closed position or if the active vent is clogged.

In a further embodiment, the method comprises determining that an out port of the active vent is blocked, if the microphone is provided externally of the users ear canal, if in a fourth comparison the measured first transfer function is greater than, with at least a fourth predetermined variance, the measured second transfer function, and if in a seventh comparison, the measured first transfer function is within a seventh predetermined variance greater than the expected first transfer function.

The fourth comparison may be provided by subtracting the measured second transfer function from the measured first transfer function, and determining if the difference is greater than a lower limit of the predetermined fourth variance.

The seventh comparison may be provided by subtracting the expected first transfer function from the measured first transfer function, and determining if the result is larger than a lower limit of the predetermined seventh variance.

A third status signal may be provided if it is determined that out port of the active vent s blocked.

In some embodiments it may be beneficial to provide a first comparison before the above mentioned fourth comparison in which first comparison it is compared if the measured first transfer function is, outside the first predetermined variance, unequal to the measured second transfer function.

In further embodiments it may be beneficial to add a fifth comparison, performed in between the fourth comparison and the seventh comparison, said fifth comparison comprising determining if the measured first transfer function is, within a fifth predetermined variance, not equal to the expected first transfer function.

The fifth comparison may be provided by subtracting the measured first transfer function from the measured first transfer function, and determining if the difference is within an upper limit and a lower limit of the predetermined fifth variance.

In a further embodiment, the method comprises determining that the first housing does not seal properly against the ear canal of the user, if the microphone is provided externally of the users ear canal, if in a fourth comparison the measured first transfer function is greater than, with at least a fourth predetermined variance, the measured second transfer function, if in a fifth comparison, the measured first transfer function is, within a fifth predetermined variance, equal to the expected first transfer function; and if in an eighth comparison, the measured second transfer function is by an eighth variance, greater than the expected second transfer function.

The fourth comparison may be provided by subtracting the measured second transfer function from the measured first transfer function, and determining if the result is greater than a lower limit of the predetermined fourth variance.

The fifth comparison may be provided by subtracting the measured first transfer function from the measured first transfer function, and determining if the difference is within an upper limit and a lower limit of the predetermined fifth variance.

The eighth comparison may be provided by subtracting the expected second transfer function from the measured second transfer function, and determining if the difference lies below an upper limit of the predetermined sixth variance.

A fourth status signal may be provided if it is determined that the first housing does not seal properly against the ear canal of the user.

In some embodiments it may be beneficial to provide a first comparison before the fourth comparison in which first comparison it is compared if the measured first transfer function is, outside the first predetermined variance, unequal to the measured second transfer function.

In further embodiments it may be beneficial to a add a sixth comparison, performed in between the fifth comparison and the eighth comparison, said sixth comparison comprising determining if the measured second transfer function differs from the expected second transfer function by at least a predetermined sixth variance.

The sixth comparison may be provided by subtracting the expected second transfer function from the measured second transfer function, and determining if the difference lies within the an upper and a lower limit of the predetermined sixth variance.

In a further embodiment, the method may comprise determining that the head wearable hearing device is working correctly, if the microphone is provided externally of the users ear canal, if in a fourth comparison the measured first transfer function is greater than, with at least a fourth predetermined variance, the measured second transfer function, if in a fifth comparison, the measured first transfer function is, within a fifth predetermined variance, equal to the expected first transfer function; and if in a sixth comparison the measured second transfer function, within a predetermined sixth variance, is equal to the expected second transfer function by at least a predetermined sixth variance.

The sixth comparison may be provided by subtracting the expected second transfer function from the measured second transfer function, and determining if the difference lies within an upper limit and a lower limit of the predetermined sixth variance.

A fifth status signal may be provided if it is determined that the head wearable hearing device is working correctly.

In some embodiments it may be beneficial to provide a first comparison before the fourth comparison in which first comparison it is compared, if the measured first transfer function is, outside the first predetermined variance, unequal to the measured second transfer function.

In a further embodiment the method may comprise determining that an out port of the active vent is blocked, if:

a. the microphone is provided in the ear canal of the user, if b. in a fourth comparison the measured first transfer function is smaller than, at least with a fourth predetermined variance, the measured second transfer function, and if c. in a seventh comparison, the measured first transfer function is within a seventh predetermined variance greater than the expected first transfer function.

The fourth comparison may be provided by subtracting the measured second transfer function from the measured first transfer function, and determining if the difference is greater than an upper limit of the predetermined fourth variance.

The seventh comparison may be provided by subtracting the expected first transfer function from the measured first transfer function, and determining if the result is larger than a lower limit of the predetermined seventh variance.

A third status signal may be provided if it is determined that out port of the active vent is blocked.

In some embodiments it may be beneficial to provide a first comparison before the fourth comparison in which first comparison it is compared if the measured first transfer function is, outside the first predetermined variance, unequal to the measured second transfer function.

In further embodiments it may be beneficial to a add a fifth comparison, performed in between the fourth comparison and the seventh comparison, said fifth comparison comprising determining if the measured first transfer function is, within a fifth predetermined variance, not equal to the expected first transfer function.

The fifth comparison may be provided by subtracting the measured first transfer function from the measured first transfer function, and determining if the difference is within the an upper limit and a lower limit of the predetermined fifth variance.

In a further embodiment, the method further comprises determining that the first housing does not seal properly against the ear canal of the user, if the microphone is provided in the ear canal of the user, if in a fourth comparison the measured first transfer function is smaller than, with at least a fourth predetermined variance, the measured second transfer function, if in a fifth comparison, the measured first transfer function is, within a fifth predetermined variance, equal to the expected first transfer function; and if in an eighth comparison, the measured second transfer function is by an eighth variance, greater than the expected second transfer function.

The fourth comparison may be provided by subtracting the measured second transfer function from the measured first transfer function, and determining if the result is greater than a lower limit of the predetermined fourth variance.

The fifth comparison may be provided by subtracting the measured first transfer function from the measured first transfer function, and determining if the difference is within the an upper limit and a lower limit of the predetermined fifth variance.

The eighth comparison may be provided by subtracting the expected second transfer function from the measured second transfer function, and determining if the difference lies below an upper limit of the predetermined sixth variance.

A fourth status signal may be provided if it is determined that the first housing does not seal properly against the ear canal of the user.

In some embodiments it may be beneficial to provide a first comparison before the fourth comparison, in which first comparison it is compared if the measured first transfer function is, outside the first predetermined variance, unequal to the measured second transfer function.

In further embodiments it may be beneficial to a add a sixth comparison, performed in between the fifth comparison and the eighth comparison, said sixth comparison comprising determining if the measured second transfer function differs from a the expected second transfer function by at least a predetermined sixth variance.

The sixth comparison may be provided by subtracting the expected second transfer function from the measured second transfer function, and determining if the difference lies within the an upper limit and a lower limit of the predetermined sixth variance.

In a further embodiment, the method may comprise determining that the head wearable hearing device is working correctly, if the microphone is provided in the ear canal of the user, if in a fourth comparison the measured first transfer function is smaller than, with at least a fourth predetermined variance, the measured second transfer function, if in a fifth comparison, the measured first transfer function is, within a fifth predetermined variance, equal to the expected first transfer function; and if in a sixth comparison the measured second transfer function, within a predetermined sixth variance, is equal to the expected second transfer function by at least a predetermined sixth variance.

The sixth comparison may be provided by subtracting the expected second transfer function from the measured second transfer function, and determining if the difference lies within the an upper limit and a lower limit of the predetermined sixth variance.

A fifth status signal may be provided if it is determined that the head wearable hearing device is working correctly.

In some embodiments it may be beneficial to provide a first comparison before the fourth comparison in which first comparison it is compared, if the measured first transfer function is, outside the first predetermined variance, unequal to the measured second transfer function.

In any of the other cases than described above, it must be determined, that the status cannot be determined, i.e. inconclusive, or that multiple errors may occur. A sixth status signal may be provided in this case.

In an embodiment the first, second, third and fourth status signals, and in further embodiments also the sixth status signal may be treated equally, as they are all indicative of some form of error. The, status signal, may in this case provide the user with the information that service is needed. However, information regarding the type of error may be preserved by the status system, such that the status signal indicative of a particular error may be retrieved, such that the error may be efficiently dealt with.

In an embodiment of the method the first, second, third, fourth, and sixth status signals (and optionally the fifth signal indicative of correct functioning of the head wearable hearing device are send to a mobile device, such as a cell phone, a pod, a pad, a portable computer etc.

In an embodiment of the method the first, second, third and fourth status signals (and optionally also the fourth signal are send to a central server.

The steps of the above described method may form part of a status test, which may be performed at regular time intervals, such as once a day, or once every week.

In a second aspect, the object may be achieved by a head wearable hearing device comprising a first housing configured for placement in an ear canal of a user, and comprising a loudspeaker and an active vent;

a first control system configured for controlling the active vent between an open state and a closed state, at least one microphone, and a status control system configured for a. receiving information regarding the intended state of said active vent;

b. providing instructions to said active vent, c. for receiving information from said at least one microphone, and for d. determining a status of the active vent by carrying out the method according to any one of the embodiments of the method according to the first aspect as described above.

The first control system and/or status control system may be may be located in first housing or in an external second housing, such as a "behind the ear" portion of the head wearable hearing device, Alternatively, the first control system and/or status control system may be provided in an external device, e.g., a cell phone (provided the collected sound information is sent via e.g. a wireless transmitter(/receiver) in the first housing.

Each of the first control system and/or status control system may comprise a digital processor and associated memory, and suitable electric connections to the loudspeaker, and to the microphone, and to the active vent, such as electric wires or wirelessly. Control functions of each of the first control system and/or status control system may be implemented by dedicated digital hardware of the digital processor or by one or more computer programs, program routines and threads of execution running on a software programmable microprocessor such as a digital signal processor or processors. Each of the computer programs, routines and threads of execution may comprise a plurality of executable program instructions. Alternatively, the respective control functions of the first control system and the status control system may be performed by a combination of dedicated digital hardware and computer programs, routines and threads of execution running on the software programmable microprocessor. The microprocessor and/or the dedicated digital hardware may be integrated on an ASIC or implemented on a FPGA device.

In an embodiment of the head wearable hearing device system, the status control system forms part of the first control system.

Preferably, the first control system is a digital feedback suppression system configured for controlling the active vent of the first housing between an open state and a closed state based on a transfer function of the acoustic feedback path.

The at least one microphone may be positioned externally, relative to the ear canal of the user. For example, the microphone may be placed a second housing of the head wearable hearing device, such as a behind the ear portion of the head wearable hearing device. Alternatively, the externally arranged microphone may be arranged on or in other parts such as glasses, an arm of headset or the like. Preferably, the microphone is located within 100 mm of the first housing 10, such as within 50 mm.

In yet other embodiments, the microphone is located on or in the first housing 10.

The head wearable hearing device may further comprise an alert-system configured for providing an alert to a user of the hearing aid system upon receipt of a status signal indicative of a failure status.

The head wearable hearing device may further comprise a wireless transmitter configured for transmitting a status signal to a remote device. The status of the active vent of the head wearable hearing device may in this case be displayed on the remote device, e.g., a cell phone app, such that the user or a next of kin may be made aware of the status. The status of the active vent of the head wearable hearing device may also be sent to a system utilized by a physician or a supplier of the head wearable hearing device, such that they may alert the user of a need for maintenance or repair.

The at least one microphone configured for receiving and measuring a transfer function of the acoustic feedback path may be comprised in the digital feedback suppression system or may be an additional microphone, It should be emphasized that the term "comprises/comprising/comprised of" when used in this specification is taken to specify the presence of stated features, integers, steps or components but does not preclude the presence or addition of one or more other features, integers, steps, components or groups thereof.

BRIEF DESCRIPTION OF THE DRAWINGS

In the following, the embodiments will be described in greater detail with reference to the enclosed figures. It should be emphasized that the embodiments shown are used for example purposes only and should not be used to limit the scope of the invention.

DETAILED DESCRIPTION OF THE EMBODIMENTS

Figure 1:
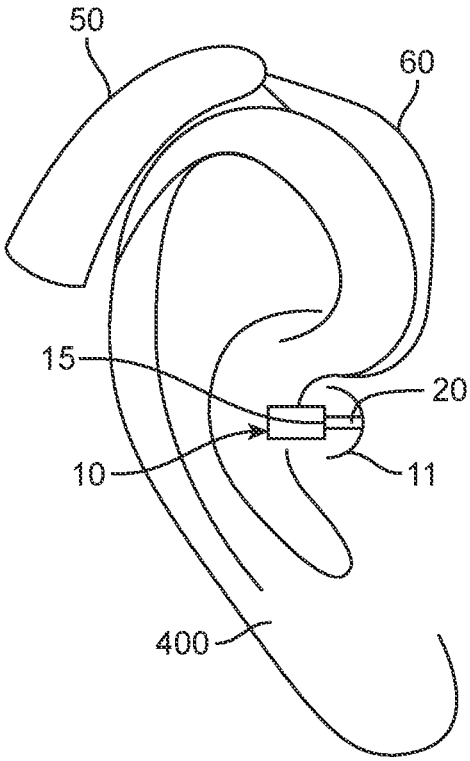
FIG. 1 shows an ear of a user and components of a system according to some embodiments.

Various exemplary embodiments and details are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

FIG. 1 shows a BTE hearing device as an exemplary embodiment. In the figure, an ear 400 of a user can be seen. The figure also shows possible components of a head wearable hearing device and a head wearable hearing device system according to some embodiments. The present disclosure also relates to a method of detecting the status of an acoustic feedback path in a head wearable hearing device and the head wearable hearing device system according to some embodiments. The acoustic feedback path is between a loudspeaker 15, which is located in the ear canal 420 (see e.g. FIG. 2B) of a user and at least one microphone 110, 110', 110" (see FIG. 3A and FIG. 3B) of the system 100. The loudspeaker 15 is arranged in a first housing 10, which is configured for being placed in the ear canal 420 of a user. The first housing 10 may be an ITE (in-the-ear) hearing device. The loudspeaker 15 provides a sound signal (acoustic signal) to the user's ear.

The microphone 110, 110', 110" may be located either internally, in the ear canal 420 of the user, i.e. in the first housing 10, or it may be located externally of the ear canal 420 of the user.

In FIG. 1, the head wearable hearing device and head wearable hearing device system in accordance with some embodiments is exemplified by a hearing aid device with an external, second housing 50, located behind the ear 400 of the user and a first housing 10 located in the ear canal 420 of the user. The first housing 10 and the second housing 50 may be connected via a first connection line 60. First connection line 60 may be provided by suitable tubing and/or electrical cables. More generally, the head wearable hearing device and head wearable hearing device system in accordance with some embodiments may comprise a first housing 10 located in the ear canal 420 of the user, and as an external second housing, which may take many forms. For example it may comprise part of a head set or similar. Also in such cases, the external housing may be connected to the first hosing 10 via suitable tubing and/or electrical cables or may be provided by a wireless connection, such as Bluetooth, or other suitable wireless technology available in the art. A microphone 110 may be provided in the second housing 50, the microphone 110 being configured for registering sounds in surroundings of the user, and the hearing aid device (or simply hearing) is configured for conveying the registered sound to the user via the loudspeaker 15 provided in the first housing 10, located in the ear canal 420 of the user. In some embodiments a power supply, e.g. batteries may be provided in the second housing 50, and via suitable electrical connection provide power also to electrical components of the first housing 10. In other embodiments the first housing 10 may comprise it's own power supply.

Figure 2A:
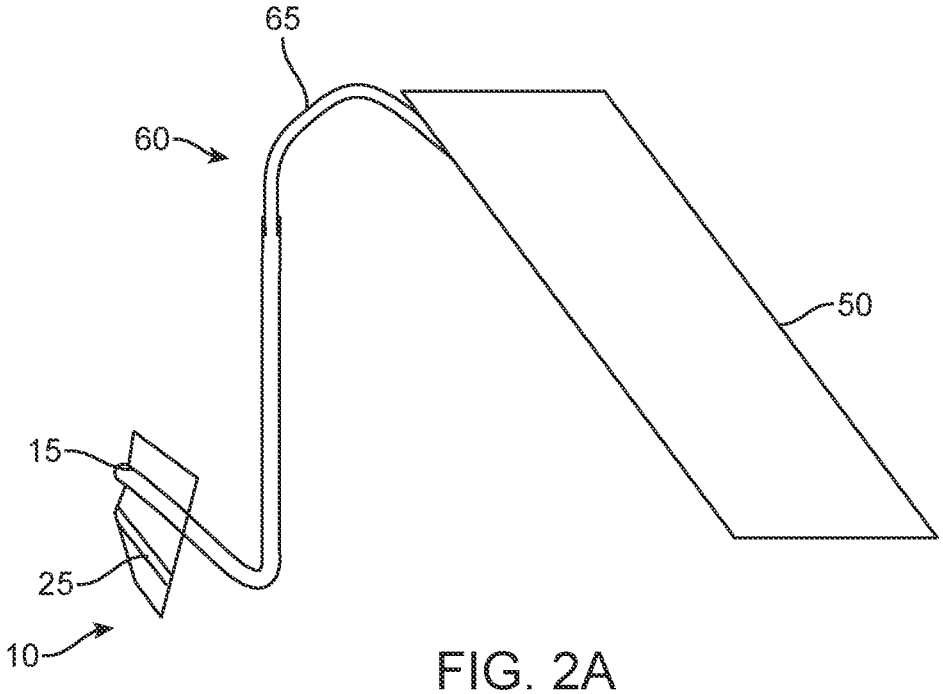
FIG. 2A shows, a prior art hearing aid comprising a first housing with a vent and a second housing, the prior art hearing aid being an example of a system in which the present embodiments may be applied.
Figure 2B:
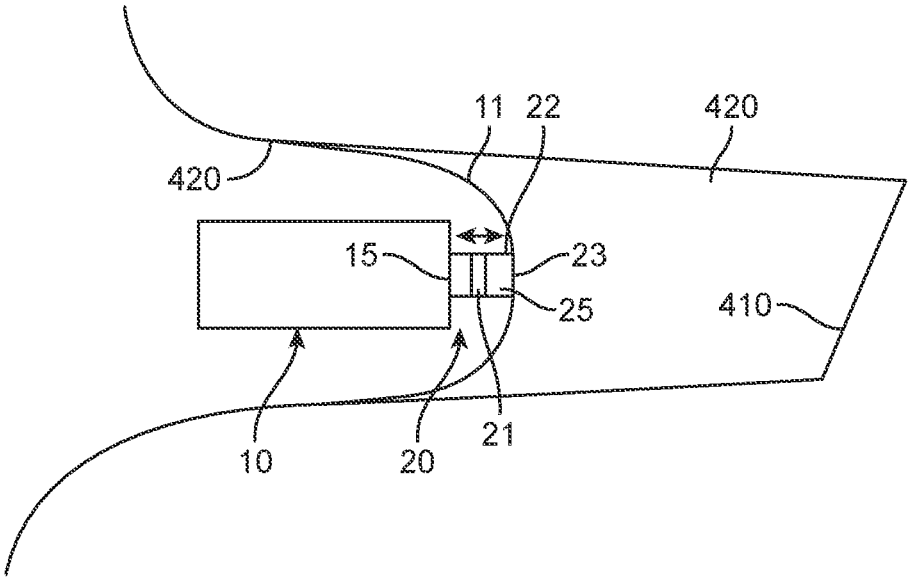
FIG. 2B, in a section view, shows a first housing of a head wearable hearing device according to an embodiment located in the ear canal of a user, the head wearable hearing device comprising an active vent.

In FIG. 2A, further details of an exemplary known head wearable hearing device/head wearable hearing device system is shown. FIG. 2A schematically shows an internal, first housing 10 to be located in the ear canal 420 (as shown in FIG. 2B), an external, second housing 50 and a first connection 60 there between. As mentioned above sounds from the surroundings of a user may be picked up and conveyed to the user via the first connection 60 and the first housing 10. The first connection in this example goes through an ear hook 65 and a tube 61.

The first housing 10 may be of a type, where an external/outer surface of the first housing 10 or at least portions, such as a proximally arranged dome 11 thereof is moldable to fit the shape of the ear canal 420 of the user, e.g. customized ear piece. Or the first housing 10 has a standard fit. In any case, the first housing 10, when inserted in the ear canal 420 forms a barrier in the ear canal 420, such that an inner volume—closest to the eardrum 410 of the user—of the ear canal is separated from an outer portion of the ear canal or the entrance to the ear canal of the user. For the comfort of the user, and in order to allow pressure equalization the first housing is equipped with a vent canal 25. The first housing 10 comprises a venting passage/vent canal 25 between first and second opposite faces of the first housing 10 to provide air passage from one side of the shell to another. The first housing 10 is shown in schematic form. Such a first housing 10 comprises an elongate shell having a proximal end, which when the first housing 10 is inserted in the ear canal 420 of the user is closest to the eardrum 410 of the user and an opposite, distal end, which when the first housing is inserted into the users ear canal is locates at or close to the entrance to the users ear canal 420. The vent canal 25 is provided in, and extends through, the first housing 10, from the proximal end of the first housing 10 to the distal end of the first housing 10, such that pressure in the inner volume of the ear canal—cut off by the first housing 420—may be equalized with a pressure externally/outside the ear canal 420 of the user.

In FIG. 2B the first housing is shown inserted in the ear anal 420 of the user. The first housing 10 further comprises a loudspeaker 15. In FIG. 2B the first housing 10 is further equipped with an active vent 20. The active vent 20 comprises the vent canal 25 and a valve member 21. The valve member 21 is configured for opening and closing the vent canal 25, such that the user may be spared from the discomfort (plugged sensation) during normal use, and be allowed to also hear low frequency sounds, when this is desirable for the user, such as when listening to music.

When active vent 20 is in a closed state, the valve member 21 blogs or closes the vent canal 25, such that passage of air—and thereby pressure equalization—is prevented. When active vent 20 is in an open state, the valve member 21 is brought into a position, where air may flow freely through the active vent 20. Thus, the valve member 21 of the active vent 20 may be actuated to a closed state, where the valve member 21 closes/shuts/blogs the vent canal 25, and to another open state, where the valve member 21 allows passage of air through the vent canal 25.

The active vent 20 may comprise an electrodynamic actuator, such as a linear actuator, responsive to the first command signal (C1) and second command signal (C2) to set the open state or the closed state of the active vent 20. The electrodynamic actuator may comprise a drive coil and a displaceable valve member 21. The displaceable valve member 21 may comprise a permanent magnet which is attracted to, or repelled by, the drive coil depending on a direction of a drive current resulting from the first and second command signals.

In the prior art, in devices having an active vent 20, the opening and closing of the active vent 20 is controlled by a first control system 200 implemented in a circuit of the head wearable hearing device.

Further, head wearable hearing devices often comprise a digital feedback suppression (DFS) system implemented in a circuit of the head wearable hearing device. The DFS system counteracts feedback by modelling the feedback path and subtracting the simulated feedback signal from the input signal at the hearing aid microphone(s).

An adaptive DFS system tracks—during wearing time—changes in the feedback path and adapts the simulated feedback path to cancel out any possibly occurring instability and/or artifacts.

Although, here the head wearable hearing device and head wearable hearing device system is described in connection with a (traditional) hearing aid, the head wearable hearing device 100 may be another type of device, e.g. headsets or earphones, or the like.

FIG. 2B, in a sectional view, shows a first housing 10 of a head wearable hearing device 100 according to an embodiment. The first housing 10 is configured for locating in the ear canal 420 of a user. The first housing 10 of the head wearable hearing device 100 comprises a domed shaped surface 11, separating an internal part of the ear canal 420 facing the ear drum 410 and an external part of the ear canal facing towards the outer ear 400, when inserted into the ear canal 420 of a user.

The first housing 10 further comprises an active vent 20 and a loudspeaker 15, often called a receiver in connection with hearing aids. The loudspeaker 15 is configured for emitting an acoustic signal into the ear canal 420 of the user, when the first housing 10 is inserted therein. For example, if the head wearable device is a hearing aid, the acoustic signal may be a copy of an acoustic signal recorded/registered e.g. by an external microphone 110 located on the second housing 50, or at another external device, and transferred to the loudspeaker, for example via the first connection 60 or wirelessly. The acoustic signal emitted from the loudspeaker, enhances the acoustic signal received from the external microphone or external device, and emits the signal into the ear canal 420, in close vicinity to the ear drum 410 of the user. In other cases the acoustic signal may in some embodiments be other sounds, e.g. music send from an external device such as a mobile/cell phone etc.

Figure 4A:
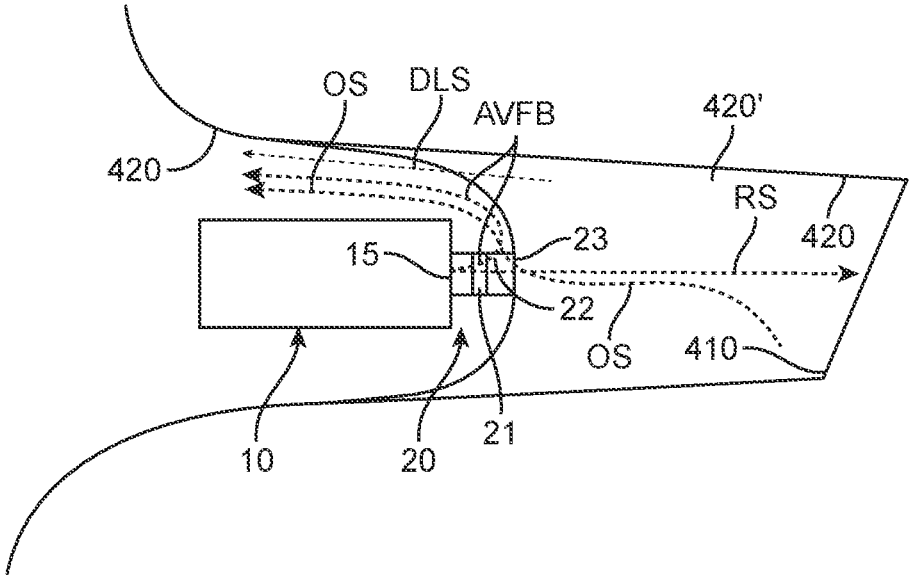
FIG. 4A shows a situation, where a first housing of a head wearable hearing device system according to some embodiments is located in the ear canal of a user, where the active vent is in an open position, the figure also showing how an acoustic feedback path is composed in this situation.

The active vent 20 comprises a vent canal 25. The vent canal 25 extends across the domed shaped surface 11 from the internal or proximal part of the ear canal 420 facing the ear drum 410 to the external or distal part of the ear canal 420 facing towards the outer ear 400, and connects the same for pressure equalization. The vent canal 25 is equipped with valve member 21 which is linearly displaceable between a position where it does not cover a vent opening 22 as shown in FIG. 2B and FIG. 4A, to a position, where the vent opening 22 is closed by the valve member 21 as shown in e.g. FIG. 4B.

Also shown in FIG. 2A is an out port 23 from where the sound from the loudspeaker 15 is emitted through the dome shaped surface 11.

The vent opening 22 and/or the out port 23 may be covered by filters to prevent passage of ear vax etc.

Figure 3A:
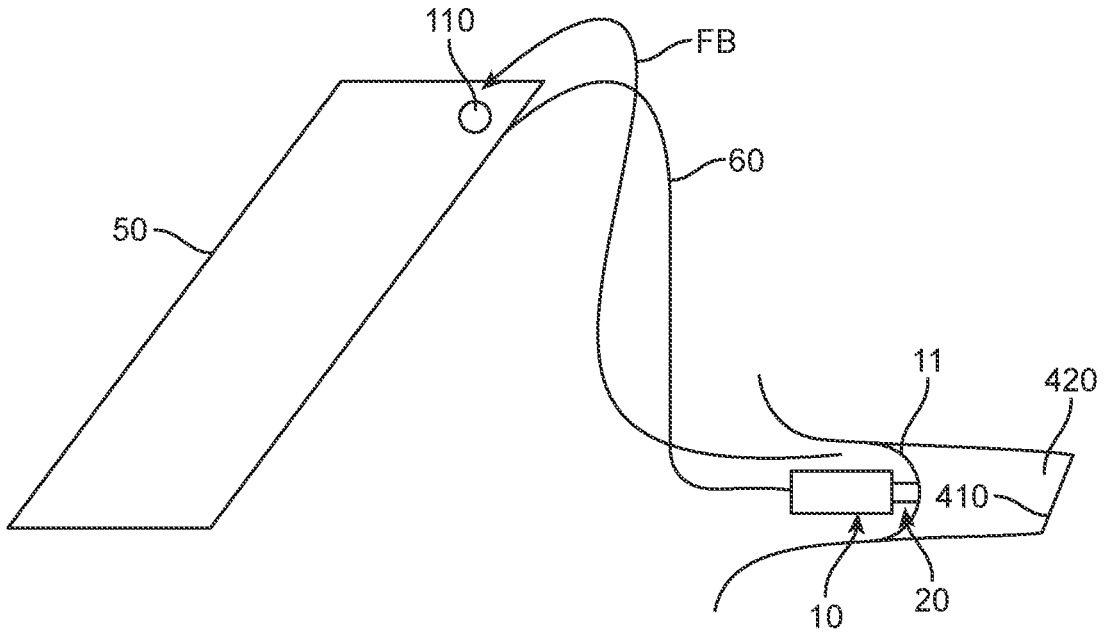
FIG. 3A, shows an embodiment of a head wearable hearing device and a head wearable hearing device system comprising a first housing inserted in an ear canal of a user, and a second housing, located externally of the ear canal of the user, and where a microphone is located in the second housing, the figure also showing an acoustic feedback path to the microphone.

FIG. 3A, shows an embodiment of a head wearable hearing device 100 and a head wearable hearing device system comprising a first housing 10 inserted in an ear canal 420 of a user, and a second housing 50, located externally of the ear canal 420 of the user, and where a microphone 110 is located in the second housing 50. The figure illustrates an acoustic feedback path FB for sound emitted from the loudspeaker 15 to the microphone 110.

Figure 3B:
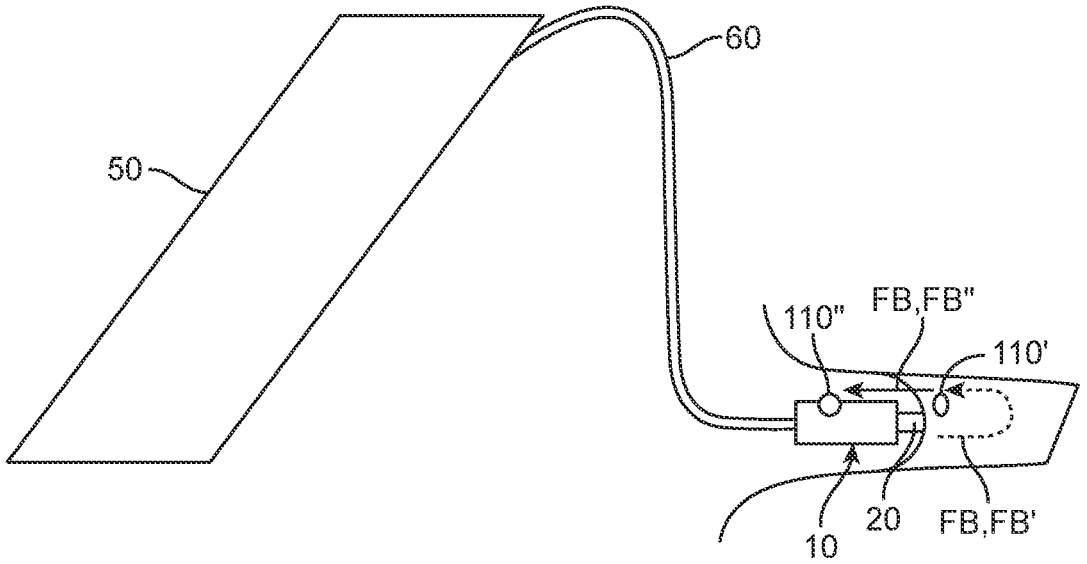
FIG. 3B, show embodiments of a head wearable hearing device and a head wearable hearing device system comprising a first housing inserted in an ear canal of a user, and a second housing, located externally of the ear canal of the user, and where a microphone is located in the first housing, the figure also showing an acoustic feedback path to the microphone.

FIG. 3B, show other embodiments of a head wearable hearing device 100 and a head wearable hearing device system comprising a first housing 10 inserted in an ear canal 420 of a user, and a second housing, located externally of the ear canal 420 of the user, and where a microphone 110', 110" for the detection of the status of an acoustic feedback path is located in the first housing 10. The figure illustrates two different locations for a microphone 110', 110". In one embodiment the microphone 110' is located at dome shaped surface 11. In another embodiment, the microphone is located on the body of the first housing 10. It will be appreciated that in various embodiments the head wearable device or other similar devices may comprise one or more microphones, located at the mentioned locations. The figure also shows an acoustic feedback path FB, FB', FB" to the microphone 110', 110". The dotted line FB, FB' shows a feedback path when the microphone 110' is located at the dome shaped surface 11. The full line FB, FB" together with the dotted line FB, FB' shows a feedback path when the microphone 110" is located on the body of the first housing 10.

With reference to FIGS. 4A-B, 5A-B and 6A-B the composition and conditions of the acoustic feedback path FB is described.

FIG. 4A shows a situation, where a first housing 10 of a head wearable hearing device 100 according to some embodiments has been inserted in the ear canal 403 of a user. The active vent 20 is open, i.e. the valve member 21 in a position, where it does not block the vent opening 22.

The figure also shows how an acoustic feedback path FB is composed in this situation. A sound is emitted from the loudspeaker 15. In FIG. 4A the emitted sound/acoustic signal is designated RS, and represented by thick dotted line. The acoustic signal travels from the loudspeaker 14 towards the ear drum 410 of the user, through the dome shaped surface 11 of the first housing 10, and into an inner part 420' of the ear canal 420. Some of the sound entering the inner part 420' of the ear canal 420 is reflected. This is the occlusion sound OS. Since in this case the vent opening 22 is open the occlusion sound OS may escape back though the out port 23 of the dome shaped surface 11. Also, some of the sound emitted from the loudspeaker 15, will however escape through the vent opening 22, since in this case, it is wide open. The sound escaping in this way is designated active vent feedback, AVFB, and represented by the dotted arrow turning through the vent opening 22. Further, a little sound will inevitably always escape across the dome shaped surface of the first housing 10. In the figure this is dome leakage sound is designated DLS and represented by the thin dotted arrow, indicating that this contribution to the acoustic feedback from the emitted sound, is smaller than the occlusion sound OS, and the active vent feedback, AVFB. It will be appreciated that the acoustic feedback signal will be the accumulated contributions of the dome leakage, DLS, the occlusion sound OS, and the active vent feedback, AVFB. The collected acoustic feedback signal will travel out of the ear. Depending on the location of the microphone 110, 110', 110", this will influence the transfer function associated with the acoustic feedback path.

Figure 4B:
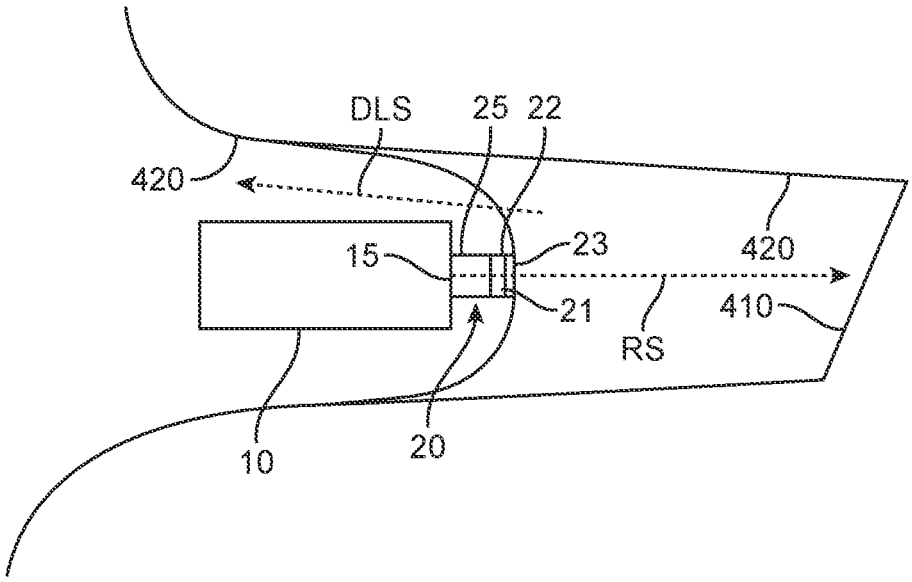
FIG. 4B shows the head wearable hearing device system of FIG. 4A, where the active vent is in an closed position, the figure also showing how an acoustic feedback path is composed in this situation.

FIG. 4B shows the head wearable hearing device 100 of FIG. 4A, where the active vent 20 is in a closed position. It can be seen that the valve member 21 has been translated to the right in the figure, and now closes the vent opening 22. The figure also shows how an acoustic feedback path is composed in this situation. Again, the emitted sound/acoustic signal is designated RS, and represented by thick dotted line. The acoustic signal travels from the loudspeaker 14 towards the ear drum 410 of the user, through the dome shaped surface 11 of the first housing 10, and into an inner part 420' of the ear canal 420. Since the valve member 21 now closes the vent opening 22. Therefore, there is no possibility of any active vent feedback, AVFB escaping, and also the occlusion sound is prevented from contributing to the feedback. Only sound escaping though the surface 11 of the dome is possible. This is indicated by the thin arrow designated DLS in FIG. 4B. Thus, it is clear that in this situation only the dome leakage sound DLS contributes to the acoustic feedback path.

It is thereby clear that, when the Active Vent (AV) 20 is in its open state, the feedback path is much stronger, than in its closed state.

This difference can be used to detect via the status control system 300 according to some embodiments, see e.g. FIG. 9, in which state the active vent 20 is. The status control system 300 may in some embodiments be built into a digital feedback suppression system, DFS, 200 already present in head wearable hearing devices with an active vent 20.

One way of doing this, is to collect a comparison normal for each of both AV states during device fitting. The feedback path determined by the status control system 300, such as the DFS, is then compared (continuously) to the normal curves to ensure, that the active vent 20 is in the right state.

Thus, the situations illustrated in FIGS. 4A-4B can be seen to represent a base line performance or norm form the correctly working system, against which comparisons may be made.

As described above, the out port 23 may preferably be covered by filter (not shown) for preventing substances, such as ear vax to enter into the first housing 10. This however increases the risk the substances build up a clogging of the out port 23.

Figure 5A:
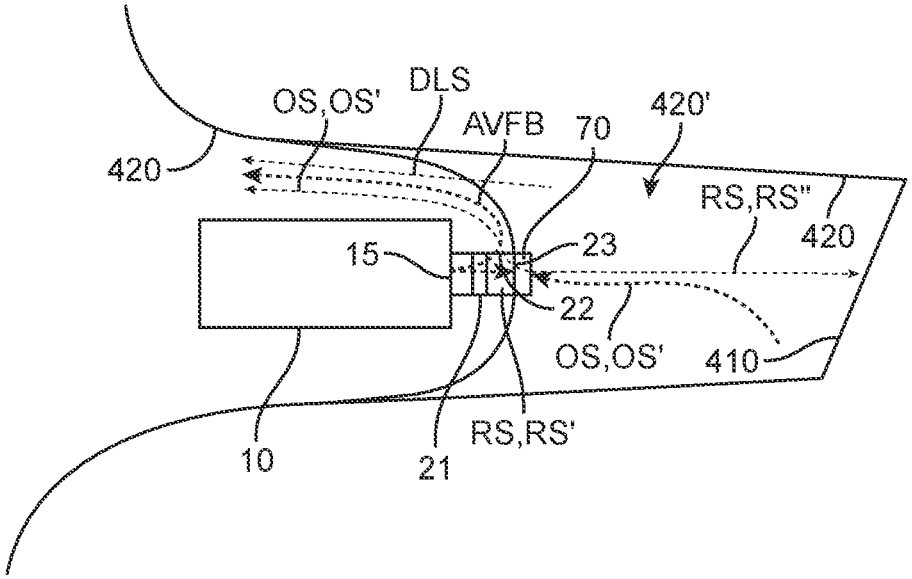
FIG. 5A shows a situation, as in FIG. 4A, where the active vent is in an open position, but where an internal out port of the vent is blocked; the figure also showing how an acoustic feedback path is composed in this situation.

FIG. 5A shows a situation, as in FIG. 4A, where the active vent is in an open position, but where an out port 23 of the active vent 20 has been clogged/blocked, e.g., by earwax, designated 70 in the figure. The figure also shows how an acoustic feedback path is composed in this situation. In FIG. 5A the emitted sound/acoustic signal is designated RS', and represented by thick dotted line until it reaches the out port 23 which is clogged by earwax 70. The clogging 70 decreases the sound RS" entering into an inner part 420' of the ear canal 420. Also, in this case, some of the sound entering the inner part 420' of the ear canal 420 is reflected as occlusion sound OS. Since in this case, sound entering the inner part 420' of the ear canal 420 is weaker, a weaker signal OS' is reflected back towards the out port 23. Further, the out port 23 is clogged 70 and therefore only some OS" of the already weaker occlusion sound escapes the vent opening 22. However, since the emitted sound RS' is partially prevented from passing the clogged out port 23, a strongly increased active vent feedback, AVFB, escapes the open vent opening 22. Again, a little sound, dome leakage sound, DLS, will escape across the dome shaped surface 11 of the first housing 10. In the figure the dome leakage sound, DLS, is represented by a thinner dotted line than in FIG. 4A is shown, indicating that the DLS contribution is weaker in this case, since the sound RS" entering the inner part 420' of the ear canal 420 was weaker in the first place. It has been found that the highly increased active vent feedback, AVFB, overcomes the decrease in the two other contributions. Therefore, it appears that a clogged out port 23 will result in a moderately increased or strengthened acoustic feedback path FB, when the active vent is open.

Figure 5B:
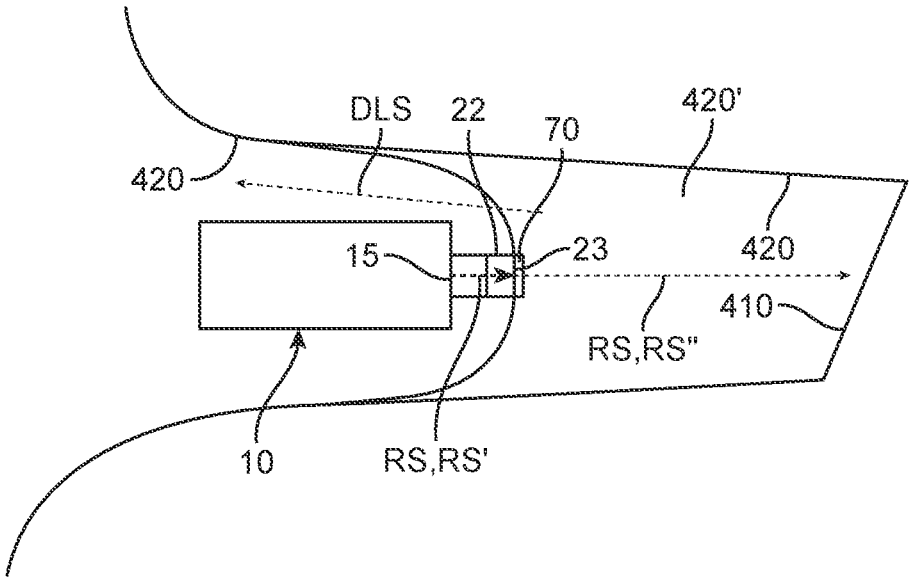
FIG. 5B shows a situation, as in FIG. 4B, where the active vent is in an closed position, but where an internal out port of the vent is blocked; the figure also showing how an acoustic feedback path is composed in this situation.

FIG. 5B shows a situation, as in FIG. 4B, where the active vent 20 is in a closed position, but where the internal out port 23 of the active vent 20 is blocked 70. The figure also shows how an acoustic feedback path is composed in this situation.

As was the case in the situation in FIG. 5A the emitted sound/acoustic signal is designated RS', and represented by thick dotted line until it reaches the out port 23 which is clogged by earwax 70. The clogging 70 decreases the sound RS" entering into an inner part 420' of the ear canal 420. However, in this case, because the valve member 21 closes the vent opening 20, no occlusion sound OS can escape and no active vent feedback, AVFB, escapes due to the closed vent opening 22. Therefore, only a little sound, dome leakage sound, DLS, will escape across the dome shaped surface 11 of the first housing 10. In the figure the dome leakage sound, DLS, is represented by a thinner dotted line than in FIG. 4B is shown, indicating that the DLS contribution is weaker in this case, since the sound RS" entering the inner part 420' of the ear canal 420 was weaker in the first place. It appears that a clogged out port 23 will result in a decreased or weakened acoustic feedback path FB, when the active vent is closed.

It has therefore been realized that a clogged 70 out-port 23 can be detected by determining the feedback path for the open and closed state of the active vent 20 (AV). In the open state of the active valve 20, the acoustic feedback path is increased compared to the norm data. In the closed state, the feedback path is decreased compared to the norm data. Further, the difference between the open and the closed state of the active vent 20 is increased.

Figure 6A:
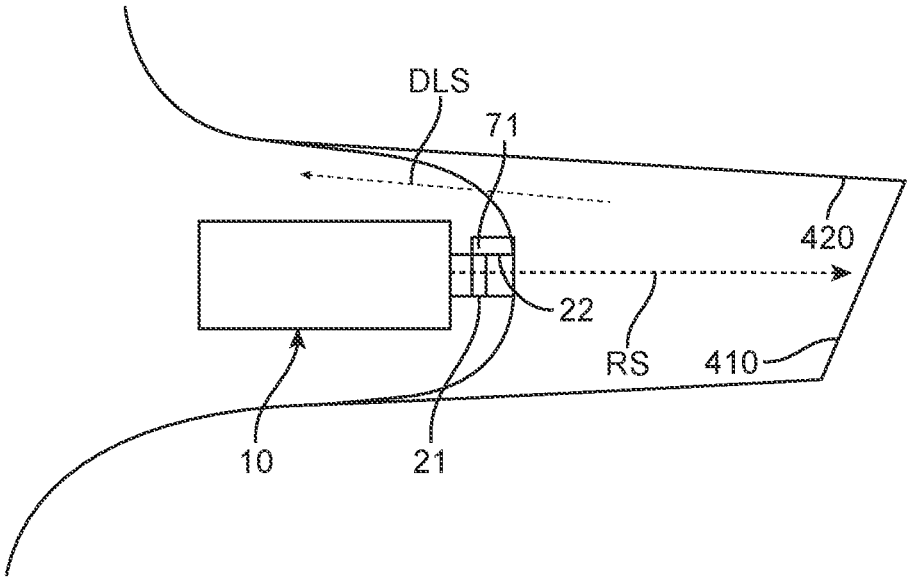
FIG. 6A shows a situation, as in FIG. 4A, where the active vent is in an open position, but where an external opening of the vent is blocked; the figure also showing how an acoustic feedback path is composed in this situation.

FIG. 6A shows a situation, as in FIG. 4A, where the active vent 20 is in an open position, but where the vent opening 22 of the active vent 20 is clogged/blocked, e.g. by earwax, designated 71 in the figure. FIG. 6A also shows how an acoustic feedback path is composed in this situation. In FIG. 6A the emitted sound/acoustic signal is designated RS, and represented by thick dotted line across the out port 23, and into the inner part 420' of the ear canal 240, since nothing blocs the distribution. Since the vent opening 22 is clogged, the occlusion sound feedback and the AVFB is prevented or highly decreased. Therefore, only a little sound, dome leakage sound, DLS, will escape across the dome shaped surface 11 of the first housing 10. In the figure the dome leakage sound, DLS, is represented by a thin dotted line.

Figure 6B:
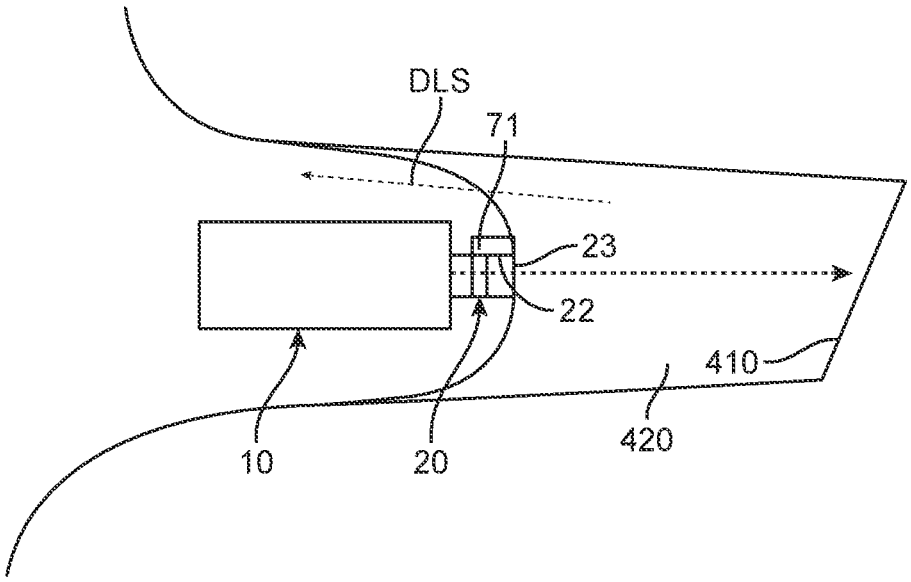
FIG. 6B shows a situation, as in FIG. 4B, where the active vent is in an closed position, but where an external opening of the vent is blocked; the figure also showing how an acoustic feedback path is composed in this situation.

FIG. 6B shows a situation, as in FIG. 4B, where the active vent 20 is in a closed position, but where a vent opening 22 of the active vent is blocked 71. Again, the figure shows how an acoustic feedback path is composed in this situation. The emitted sound/acoustic signal is designated RS, and represented by thick dotted line across the out port 23, and into the inner part 420' of the ear canal 240, since nothing blocs the distribution. Since the vent opening 22 is clogged, and since it is also closed, the occlusion sound feedback as well as the AVFB is prevented. Therefore, only a little sound, dome leakage sound, DLS, will escape across the dome shaped surface 11 of the first housing 10. In the figure the dome leakage sound, DLS, is represented by a thin dotted line.

It has therefore been realized that a clogged out-port 23 can be detected by determining the feedback path for the open and closed state of the active vent 20.

In open state, the feedback path is decreased compared to the norm data.

In closed state, the feedback path is matching to the norm data. The open/closed state difference is decreased.

Figure 7:
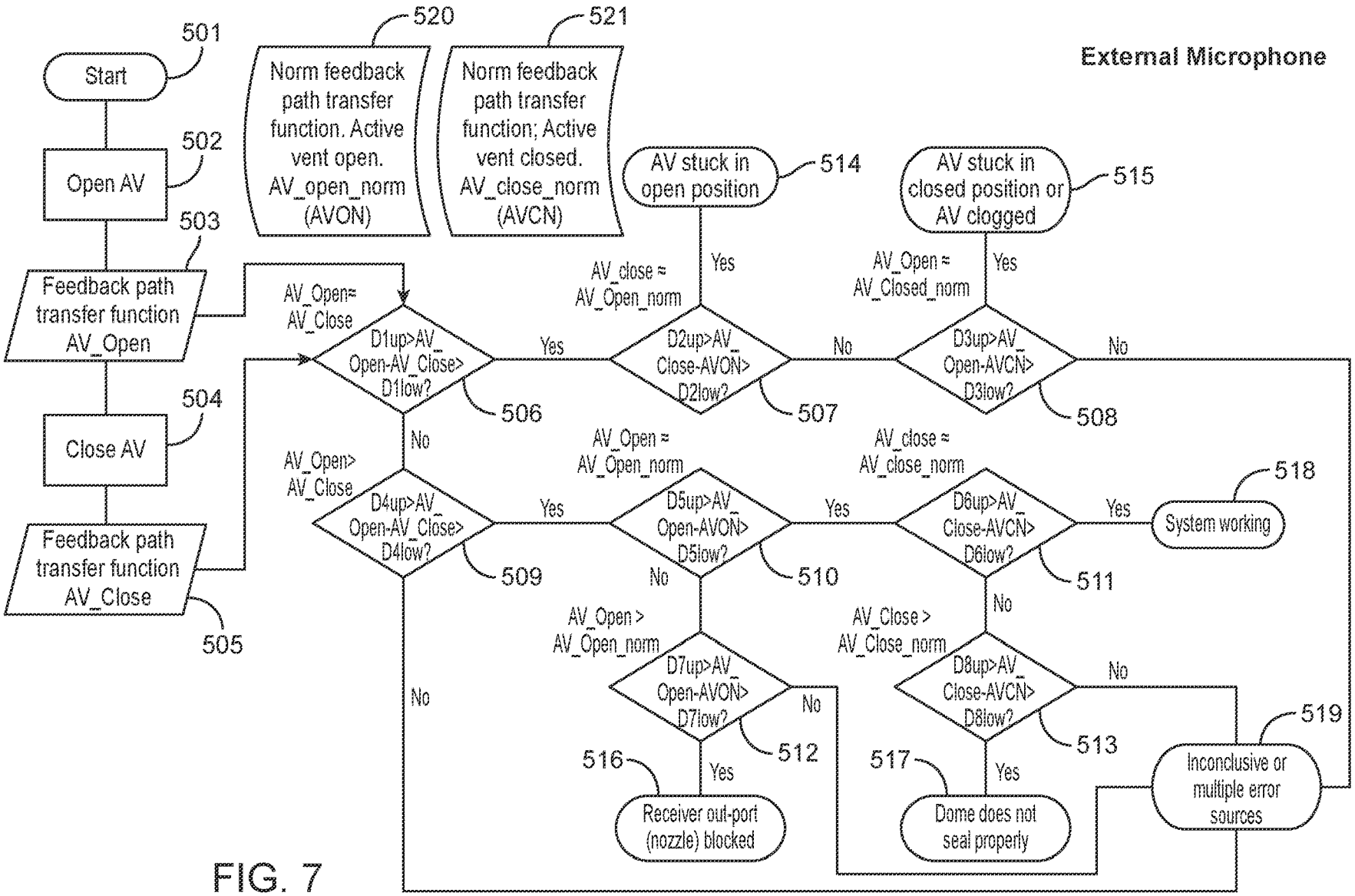
FIG. 7 shows a diagram of an embodiment of a method for determining a status of the acoustic feedback path of the system, in embodiments where the microphone of the system is arranged externally of the ear canal of the user.

FIG. 7 shows a flow chart of steps of a method for determining a status of the acoustic feedback path of the head wearable hearing device according to some embodiments. The flow chart in shown in FIG. 7 concerns embodiments, where the microphone is arranged externally of the ear canal 420 of the user.

In the left side of the flow chat/diagram, the reference number 501 indicates the start of the method. The first step 502 is to send a command signal C1 to the active vent 20 to assume the open state. Meanwhile, a sound signal is provided, by emitting an acoustic signal RS from the loudspeaker 15. This may be either a control sound or a normal sound pattern from the surroundings. In the step 503 a first transfer function AV_Open between the loudspeaker/receiver 15 and the microphone 110, in response to the emitted signal RS is measured. Then in step 504 a second command signal, C2, is provided to the active vent 20 to assume the closed open state, while, a sound signal is provided, by emitting an acoustic signal RS. In the step 505 a second transfer function AV_Close between the loudspeaker 15 and the microphone 110 in response to the emitted signal RS is measured. Based at least on these collected information, the state of the active vent 20 may be determined.

The determination of the state of the active vent 20 may be improved by determining an expected first transfer function, AV_open_norm (AVON) for the acoustic feedback path FB between the loudspeaker 15 and the microphone 110 in response to the emitted acoustic signal RS corresponding to an open state of the active vent 20. The determination of the expected first transfer function, AVON may be based on measurements made during a fitting session for adapting the head wearable hearing device 100 to a specific user. Based on these measurements a norm feedback transfer function which corresponds to the expected first transfer function, AVON, for the active vent 20 in open state is made and stored in a status control system 300 for use in the method, see 520 in FIG. 7.

The determination of the state of the active vent 20 may be improved by determining an expected second transfer function, AV_Close-norm (AVCN) for the acoustic feedback path FB between the loudspeaker 15 and the microphone 110 in response to the emitted acoustic signal RS corresponding to a closed state of the active vent 20. The determination of the expected second transfer function AVCN, may be based on measurements made during a fitting session for adapting the head wearable hearing device 100 to a specific user. Based on these measurements a norm feedback transfer function which corresponds to the expected second transfer function, AVCN, for the active vent 20 in the closed state is made and stored in a status control system 300 for use in the method, see 521 in FIG. 7.

Based at least on these collected information, the state of the active vent 20 may be determined.

In step 514 it may be determined if the active vent 20 is stuck in an open position based on a series of forgoing steps: in a first comparison, step 506, it is determined if the measured first transfer function AV_Open is, within the first predetermined variance D1, equal to the measured second transfer function AV_Close; and in step 507 it is determined if the measured second transfer function AV_Close is, within a predetermined second variance D2, equal to the expected first transfer function AVON. If this is the case then the active vent 20 is stuck in an open position, and a first status signal S1 may be provided indicative of the active vent 20 being stuck in an open position.

In a step 515 it may be determined if the active vent 20 is stuck in a closed position or that the active vent 20 is clogged, based on a series of forgoing steps: in the first comparisons, step 506, it is determined if the measured first transfer function AV_Open is, within the first predetermined variance D1, equal to the measured second transfer function AV_Close; and then in the second Comparison, step 507, it is determined if the measured second transfer function AV_Close is, within the predetermined second variance D2, not equal to the expected first transfer function AVON, and in a third comparison, step 508, it is determined if the measured first transfer function AV_Open is, within the third predetermined variance D3, equal to the expected second transfer function AVCN. If this is the case then the active vent 20 is either stuck in a closed position or the active vent 20 is clogged, and a second status signal S2 may be provided, the second status signal being indicative of the active vent 20 being stuck in closed position or the active vent 20 being clogged.

In a step 516 it may be determined if an out port 23 of the active vent 20 is blocked, based on a series of at least the forgoing steps: in a fourth comparison, step 506, it is determined if the measured first transfer function AV_Open is greater than, the measured second transfer function AV_Close, with at least a fourth predetermined variance D4, and in a seventh comparison step 512 it is determined if the measured first transfer function AV_Open is within a seventh predetermined variance D7 greater than the expected first transfer function AVON. If this is the case then the out port 23 of the active vent 20 is blocked. A third status signal S3 may be provided if it is determined that out port 23 of the active vent 20 is blocked.

In a step 517 it may be determined if the first housing 10 does not seal properly against the ear canal 420 of the user, based on a series of at least the forgoing steps: in a fourth comparison, step 506, it is determined if the measured first transfer function AV_Open is greater than, the measured second transfer function AV_Close, with at least a fourth predetermined variance D4 and in a fifth comparison, step 510, it is determined if the measured first transfer function AV_Open is, within a fifth predetermined variance D5, equal to the expected first transfer function AVON, and in an eighth comparison, step 513, it is determined if the measured second transfer function AV_Close is by an eighth variance D8, greater than the expected second transfer function AVCN. If this is the case then the first housing 10 does not seal properly against the ear canal 420 of the user. A fourth status signal S4 may then be provided if it is determined that the first housing 10 does not seal properly against the ear canal 420 of the user.

In a step 518 it may be determined that the head wearable hearing device 100 is working correctly, based on a series of at least the forgoing steps: in a fourth comparison, step 506, it is determined if the measured first transfer function AV_Open is greater than, the measured second transfer function AV_Close, with at least a fourth predetermined variance D4 and in a fifth comparison, step 510, it is determined if the measured first transfer function AV_Open is, within a fifth predetermined variance D5, equal to the expected first transfer function AVON, and in a sixth comparison, step 511, it is determined if the measured second transfer function AV_Close, within a predetermined sixth variance D6, is equal to the expected second transfer function AVCN. If this is the case then the head wearable hearing device 100 is working correctly. A fifth status signal S5 may be provided if it is determined that the head wearable hearing device 100 is working correctly.

Figure 8:
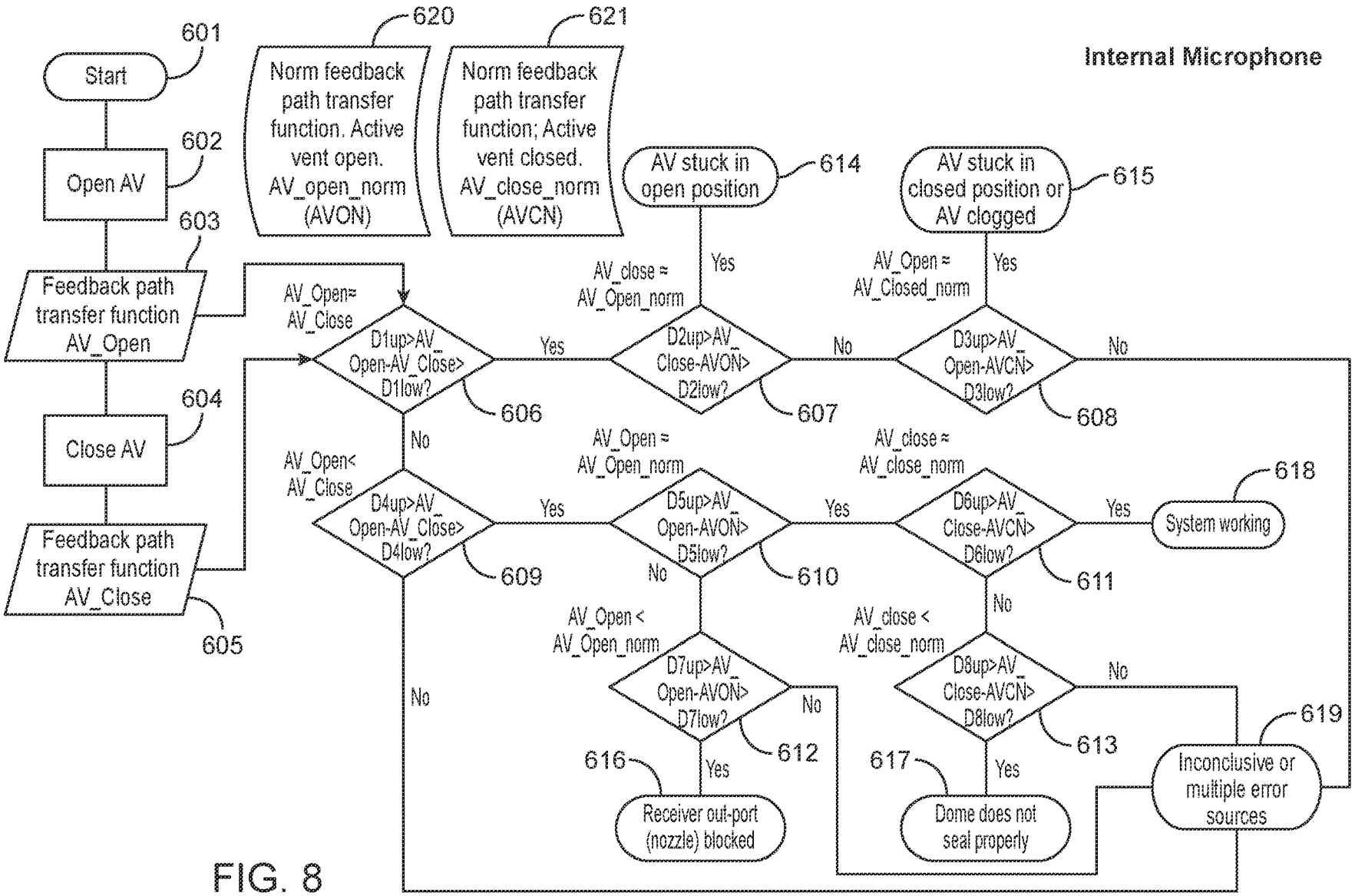
FIG. 8 shows a diagram of an embodiment of a method for determining a status of the acoustic feedback path of the system, in embodiments where the microphone of the system is arranged in the ear canal of the user

FIG. 8 shows a flow chart of steps of another embodiment of a method for determining a status of the acoustic feedback path of the head wearable hearing device. The flow chart in shown in FIG. 8 concerns embodiments, where the microphone is arranged in connection with the first housing 10 in the ear canal 420 of the user. The steps are basically the same as described above in connection with FIG. 7. In FIG. 8 and the corresponding embodiments, the reference numbers are the same as in FIG. 7 except that they are in the 600's instead of the 500's in the FIG. 7 embodiment. Only one step, step 609 differs from that of step 509. In step 509, a fourth comparison is made whether the measured first transfer function is greater than the measured second transfer function (respective of a fourth deviance). In step 609, the fourth comparison tests if the measured first transfer function is smaller than the measured second transfer function (respective of the fourth deviance).

In any of the other cases, than described above in connection with FIG. 7 and FIG. 8, it is determined, in a step 519, 619, that the status cannot be determined, i.e. inconclusive, or that multiple errors may occur. A sixth status signal S6 may be provided in this case.

It is to be noted that the figures and the above description have shown the example embodiments in a simple and schematic manner.

As used in this specification, the term "predetermined variance" or similar terms, such as "variance", may refer to any value, such as zero, or a value that is greater than zero. Also, two or more of the variance described herein may have the same value, or may have different respective values.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

PARTS LIST

10 first housing (in the ear)
11 dome
15 loudspeaker
20 active vent
21 valve member
22 valve opening
23 nozzle outlet/out port
25 valve canal
50 external housing
60 connection between external housing and first housing
61 tube
65 ear hook
70 clogging of outlet of valve canal/nozzle outlet
71 clogging of valve opening
100 head wearable hearing device
110 microphone at external housing
110' microphone at dome of first housing
110" microphone at external side of dome of first housing
200 first control system, such as digital feedback suppression (DFS) system
300 status control system
400 ear of a user
410 ear drum of user
420 ear canal of user
500 method when microphone is external to the ear canal of the user
600 method, when microphone is in the ear canal of the user
FB acoustic feedback path
RS sound/acoustic signal emitted from loudspeaker
OS occlusion sound feedback
AVFB active vent feedback
DLS dome leakage sound feedback
C1 first command signal
C2 second command signal
T1 predetermined first time window
T2 predetermined second time window
AV_Open measured first transfer function
AV_Close measured second transfer function
AVON expected first transfer function
AV_open_norm=AVON, expected first transfer function
AVCN expected second transfer function
AV_close_norm=AVCN, expected second transfer function
D1 first variance
D1up upper limit of first variance
D1low lower limit of first variance
D2 second variance
D2up upper limit of second variance
D2low lower limit of second variance
D3 third variance
D3up upper limit of third second variance
D3low lower limit of third variance
D4 fourth variance
D4up upper limit of fourth variance
D4low lower limit of fourth variance
D5 fifth variance
D5up upper limit of fifth variance
D5low lower limit of fifth variance
D6 sixth variance
D6up upper limit of sixth variance
D6low lower limit of sixth variance
D7 seventh variance
D7up upper limit of seventh variance
D7low lower limit of seventh variance
D8 eighth variance
D8up upper limit of eighth variance
D8low lower limit of eighth variance

The invention claimed is:

1. A method performed by a hearing device, the hearing device comprising a first housing configured for placement in an ear canal of a user, a microphone, a speaker, and a first control system configured to control an active vent to place the vent in an open state or a closed state, the active vent comprising a vent canal and a valve member configured to block the vent canal when the active vent is in the closed state, and to allow passage of air through the vent canal when the active vent is in the open state, the method comprising:

emitting an acoustic signal from the speaker;

determining a first transfer function of an acoustic feedback path between the speaker and the microphone, the first transfer function corresponding to an expected open state for the active vent;

determining a second transfer function of the acoustic feedback path between the speaker and the microphone, the second transfer function corresponding to an expected closed state for the active vent; and determining a status of the active vent based on both the first and second transfer functions, wherein the status that is determined based on both the first and second transfer functions indicates a state of the active vent at a timepoint.

2. The method according to claim 1, further comprising providing a first command signal to open the active vent, wherein the first transfer function is determined in a predetermined first time window after the first command signal is provided.

3. The method according to claim 2, further comprising providing a second command signal to close the active vent, wherein the second transfer function is determined in a predetermined second time window after the second command signal is provided.

4. The method according to claim 3, wherein the act of determining the status comprises performing a first comparison of the first transfer function and/or the second transfer function relative to a first predetermined variance.

5. The method according to claim 1, further comprising:

determining an expected first transfer function for the acoustic feedback path between the speaker and the microphone in response to the emitted acoustic signal corresponding to the open state of the active vent, and/or determining an expected second transfer function for the acoustic feedback path between the speaker and the microphone in response to the emitted acoustic signal corresponding to the close state of the active vent;

wherein the state of the active vent is determined further based on a comparison of the first and/or the second transfer functions, with the expected first transfer function, or the expected second transfer function.

6. The method according to claim 5, wherein the expected first transfer function and/or the expected second transfer function is determined based on measurements made during a fitting session for adapting the hearing device to the user.

7. The method according to claim 6, further comprising:

determining a first norm feedback transfer function for the open state of the active vent based on the measurements; and determining a second norm feedback transfer function for the closed state of the active vent based on the measurements; and storing the first and second norm feedback transfer functions in a status control system.

8. The method according to claim 1, wherein the first control system comprises an adaptive digital feedback suppression system.

9. The method according to claim 8, wherein the adaptive digital feedback suppression system comprises an adaptive digital filter, the adaptive digital filter comprising a plurality of filter coefficients modelling an impulse response of the acoustic feedback path or modelling a frequency response of the acoustic feedback path.

10. The method according to claim 8, further comprising determining an expected transfer function for the acoustic feedback path in response to the emitted acoustic signal based on information from the digital feedback suppression system.

11. The method according to claim 1, wherein the status of the active vent indicates that the active vent is in the open state, if the first transfer function is equal to the second transfer function within a first predetermined variance, and if the second transfer function is equal to an expected transfer function within a predetermined second variance.

12. The method according to claim 1, wherein the status of the active vent indicates that the active vent is in the closed state or that the active vent is clogged, if the first transfer function is equal to the second transfer function within a first predetermined variance, if the second transfer function is not equal to a first expected transfer function within a predetermined second variance, and if the first transfer function is equal to a second expected transfer function within a third predetermined variance.

13. The method according to claim 1, further comprising determining that an out port of the active vent is blocked, if the microphone is outside the ear canal, if the first transfer function is greater than the second transfer function by a predetermined variance, and if the first transfer function is greater than an expected transfer function by another predetermined variance.

14. The method according claim 1, further comprising determining that the first housing does not seal properly against the ear canal of the user, if the microphone is outside the ear canal, if the first transfer function is greater than the second transfer function by a predetermined variance, if the first transfer function is equal to a first expected transfer function within another predetermined variance, and if the second transfer function is greater than a second expected transfer function by a further predetermined variance.

15. The method according to claim 1, further comprising determining that the hearing device is working correctly, if the microphone is outside the ear canal, if the first transfer function is greater than the second transfer function by a predetermined variance, if the first transfer function is equal to a first expected transfer function within another predetermined variance; and if the second transfer function is equal to a second expected transfer function within a further predetermined variance.

16. The method according to claim 1, further comprising determining that an out port of the active vent is blocked, if the microphone is in the ear canal, if the first transfer function is smaller than the second transfer function by a predetermined variance, and if the first transfer function is greater than an expected transfer function by another predetermined variance.

17. The method according to claim 1, further comprising determining that the first housing does not seal properly against the ear canal of the user, if the microphone is in the ear canal, if the first transfer function is smaller than the second transfer function by a predetermined variance, if the first transfer function is equal to a first expected transfer function within another predetermined variance, and if the second transfer function is greater than a second expected transfer function by a further predetermined variance.

18. The method according to claim 1, further comprising determining that the hearing device is working correctly, if the first transfer function is smaller than the second transfer function by a predetermined variance, if the first transfer function is equal to a first expected transfer function within another predetermined variance, and if the second transfer function is equal to a second expected transfer function within a further predetermined variance.

19. The method according to claim 1, wherein the status of the active vent is determined based at least on one or more comparisons performed using the first and second transfer functions.

20. A hearing device comprising:

a first housing configured for placement in an ear canal of a user;

a speaker configured to emit an acoustic signal;

an active vent;

a first control system configured to control the active vent to place the active vent in an open state or a closed state;

at least one microphone; and a status control system configured to:

receive information regarding an expected state of the active vent;

determine a first transfer function of an acoustic feedback path between the speaker and the microphone, the first transfer function corresponding to an expected open state for the active vent;

determine a second transfer function of the acoustic feedback path between the speaker and the microphone, the second transfer function corresponding to an expected closed state for the active vent; and determine a status of the active vent based on both the first and second transfer functions, wherein the status that is based on both the first and second transfer functions indicates a state of the active vent at a timepoint.

21. The hearing device according to claim 20, wherein the status control system is a part of the first control system.

22. The hearing device according to claim 20, wherein the first housing comprises a proximal end and a distal end, and wherein when the active vent is in the open state, air can flow through the first housing from the proximal end to the distal end.

* * * * *